US011505964B2

(12) United States Patent
Knudsen

(10) Patent No.: US 11,505,964 B2
(45) **Date of Patent: *Nov. 22, 2022**

(54) FENCE PANEL CONSTRUCTION SYSTEM AND METHOD

(71) Applicant: N. Eric Knudsen, Maple Valley, WA (US)

(72) Inventor: N. Eric Knudsen, Maple Valley, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/349,581

(22) Filed: Jun. 16, 2021

(65) Prior Publication Data

US 2022/0106811 A1 Apr. 7, 2022

Related U.S. Application Data

(63) Continuation of application No. 15/919,736, filed on Mar. 13, 2018, now Pat. No. 11,060,321, which is a continuation of application No. 14/210,031, filed on Mar. 13, 2014, now Pat. No. 9,945,149.

(60) Provisional application No. 61/779,577, filed on Mar. 13, 2013.

(51) Int. Cl.
*E04H 17/26* (2006.01)
*E04H 17/14* (2006.01)

(52) U.S. Cl.
CPC ..... *E04H 17/263* (2013.01); *E04H 17/143* (2013.01); *E04H 17/1447* (2021.01); *E04H 17/146* (2021.01); *Y10T 29/49629* (2015.01); *Y10T 29/53539* (2015.01)

(58) Field of Classification Search
CPC . E04H 17/263; E04H 17/143; E04H 17/1447; E04H 17/146; Y10T 29/53539; Y10T 29/49629; Y10T 29/49833; Y10T 29/4978; B27F 7/155; B27F 7/15; F16B 15/0023
See application file for complete search history.

(56) References Cited

U.S. PATENT DOCUMENTS

| | | | | |
|---|---|---|---|---|
| 3,711,007 | A | 1/1973 | Fry | |
| 4,583,278 | A | 4/1986 | Flores et al. | |
| 6,658,753 | B2 * | 12/2003 | Tatarnic | G01C 15/02 33/645 |
| 6,916,128 | B1 | 7/2005 | Petteruti et al. | |
| 7,559,147 | B2 | 7/2009 | Fleeman | |
| 7,861,434 | B2 | 1/2011 | Knudsen | |

(Continued)

*Primary Examiner* — Ryan J. Walters
(74) *Attorney, Agent, or Firm* — Seed Intellectual Property Law Group LLP

(57) ABSTRACT

A fence panel construction device includes a structural member and a pair of post members coupled to the structural member. Each post member includes a pair of attachment devices configured to removably attach a pair of fence stringers to the pair of post members. A pair of actuator mechanisms are coupled to a respective one of the pair of post members to position the pair of post members corresponding to a pair of fence posts on a property. A finishing assembly is coupled to the structural member and includes at least one fastening device and at least one trimming device both operable to move vertically. The finishing assembly is operable to move horizontally while the at least one fastening device fastens fence boards to the pair of fence stringers and at least one trimming device trims the fence boards. A method of making a fence panel is provided.

14 Claims, 2 Drawing Sheets

(56) References Cited

U.S. PATENT DOCUMENTS

| | | | | |
|---|---|---|---|---|
| 9,945,149 | B2 | 4/2018 | Knudsen | |
| 11,060,321 | B2 * | 7/2021 | Knudsen | E04H 17/143 |

* cited by examiner

FENCE PANEL CONSTRUCTION SYSTEM AND METHOD

BACKGROUND

Technical Field

The disclosed embodiments relate in general to systems and methods for making fences, and in particular, to systems for manufacturing custom fence panels to install on a property.

Description of the Related Art

Fences are ubiquitous in modern society, used in a vast range of applications, to mark and accent boundaries, provide security, and control movement of people and animals. Thousands of miles of new and replacement fences are installed every year in the U.S., and utilize vast amounts of construction-related natural resources.

Fence panels of a fence typically include a pair of stringers and a plurality of boards or panels attached thereto. Fence panels are secured to vertically oriented fence posts that are secured to the ground. Typically, after a fence line has been established, numerous fence posts are installed in footings in the ground. Once the fence posts are secured, pairs of stringers may be secured to and between adjacent fence posts along the fence line. Depending upon the terrain of a particular property, stringers may be positioned substantially horizontal or at an angle relative to horizontal (sometimes at a severe angle) between adjacent fence posts. Once the stringers are secured to a certain pair of fence posts, fence boards are secured to the stringers to complete a fence panel extending between adjacent fence posts. This process continues until the fence is completed.

The steps to create a fence are typically performed on-site. As such, numerous individuals must transport numerous tools and hoses/lines to each fence panel location to install the fence panel to the fence posts. Thus, workers, tools, and materials are exposed to the elements, such as rain, snow, and mud. For very large fences that require months to construct, the process of installing a fence can be daunting and quite costly under existing systems.

BRIEF SUMMARY

A fence panel construction device may be summarized as a machine operable to create a complete fence panel for attachment to a particular pair of fence posts on a property. Accordingly, individual fence panels are custom built depending upon the positions of respective pairs of fence posts on the property.

For example, a fence may be designed according to the systems and methods disclosed in U.S. patent application Ser. No. 12/403,385, issued as U.S. Pat. No. 7,861,434. Accordingly, a plurality of fence post sleeves may be installed on the property and may be ready to receive fence posts and fence panels in the construction of a fence. Alternatively, the fence posts may be already installed on the property and ready to receive fence panels secured thereto. As such, the positions of the post sleeves and/or fence posts are predetermined and are known. Such positional information may also be recorded, such as in a database. The position of each post sleeve and/or fence post may have a particular x, y, and z position relative to adjacent posts or sleeves. Once the position of each post sleeve and/or fence post is known, the fence panel construction device is used to complete a plurality of individual fence panels to be installed on adjacent fence posts on the property. The individual fence panels may be completed on-site or off-site, depending upon the location of the fence panel construction device.

In some embodiments, the construction device includes a structural member, such as a frame or chassis, supporting a variety of components and devices. At least one actuator device is coupled to the frame and operates to move each one of a pair of post members (or other support members) to a position corresponding to or otherwise reflective of the positions of a certain pair of fence posts or post sleeves on a property. In this manner, the post members can be used to replicate the position of the certain pair of fence posts of post sleeves for fabricating a fence panel that fits between said fence posts or post sleeves fitted with posts. It is appreciated that the post members (or other support members) may not necessarily be positioned at the same location of the pair of fence posts or post sleeves, but may be offset therefrom. A pair of stringers may be removably attached to the pair of post members (or other support members) via fixtures or the like and supported in a position corresponding to or otherwise reflective of the position and orientation the stringers would be in relative to the certain pair of fence posts or post sleeves on the property after installation. In some instances, the stringers may extend beyond the position of the fence posts or post sleeves fitted with posts to which the stringers will be attached and subsequently trimmed to length to fit between the same as described herein. The construction device may be described as replicating or simulating the environment between two fence posts or fence post sleeves for the construction of a complete fence panel that fits between said fence posts or posts fitted said post sleeves. A plurality of panels, such as fence boards, may be positioned to overlie the stringers. A plurality of panels, such as fence boards, may also be positioned on an opposing side of the stringers and/or arranged in a variety of fence panel configurations. Each fence board may be positioned substantially vertically and adjacent other fence boards, as shown in FIG. 1. Each fence board may abut adjacent fence boards or may be spaced or offset therefrom. Spacers may be provided for maintaining a generally constant spacing between said fence boards when the desired fence configuration includes such spacing.

In some embodiments, a topography member is coupled to the frame and is operable to position the lower ends of the fence boards according to the terrain of the property between the certain pair of fence posts.

Once all the fence boards are properly positioned, the fence boards are fastened to the stringers. A finishing assembly is coupled to the frame and includes a plurality of devices. The finishing assembly is configured to move and operate said plurality of devices in any direction on the x-y plane to fasten and trim the fence boards, for example. The finishing assembly includes a horizontal pair of guide members positioned substantially parallel to each other at respective upper and lower areas of the construction device. The finishing assembly may include a fastener array having a vertical support member. The vertical support member is coupled to the pair of horizontal guide members and is movable in horizontal directions along the guide members during operation. A motor or manual device may be used to move the fastener array in said horizontal directions. Thus, the plurality of devices are moveable horizontally and vertically proximate the fence panel.

The fastener array may include at least one fastening device attached to the vertical support member. The at least one fastening device is movable along the vertical support member in the y direction. While the fastener array is moved in a horizontal direction relative to the fence boards and stringers, the at least one fastening device is movable in the vertical direction. Due to such freedom of movement on the x-y plane, the at least one fastening device is operable to fasten all of the fence boards to respective stringers. This is particularly advantageous when the stringers are positioned at an angle relative to horizontal because the at least one fastening device can be operated to fasten fence boards to stringers at any position (FIG. 1). One or more additional fastening devices may be provided to operate on an opposing side of the stringers to facilitate fastening of fence boards to both sides of the stringers if desired.

The fastener array may further include at least one trimming device attached to the vertical support member and operable to trim portions of the fence panel. As the fastener array is moved in a horizontal direction, the at least one trimming device is movable in the vertical direction and is operable to trim the fence boards to a desired length and shape. The trimming device may also be used to trim the stringers to length to fit between a pair of fence posts or post sleeves fitted with posts. In some instances, the stringers may be supported to overhang or extend beyond the post members of the fence construction device to facilitate trimming thereof.

In some embodiments, a computer system is coupled to the construction device and is configured to cause all or some of the operations discussed in the present disclosure to create a custom fence panel. The computer system may control the placement and position of the stringers and the fence boards. The computer system may control the movement of the fastener array and movement of its devices. The computer system may control operation of the fastening device(s) and the trimming device(s).

In some embodiments, the construction device is a mobile unit that is transportable, such as to a job site where the fence panels are to be installed.

A method of making a fence panel includes positioning a first post member in a position corresponding to or otherwise reflecting or simulating an environment associated with a first fence post on a property and positioning a second post member in a position corresponding to or otherwise reflecting or simulating an environment associated with a second fence post on the property. The method includes supporting a first stringer to the first post member and the second post member and supporting a second stringer to the first post member and the second post member. A plurality of fence boards are overlaid the first and second stringers. The plurality of fence boards are fastened to the first and second stringers with at least one fastening device operable to move in a direction along the plurality of fence boards. The method may include cutting the plurality of fence boards with at least one trimming device operable to move in a direction along the plurality of fence boards.

DETAILED DESCRIPTION

Figure 1:
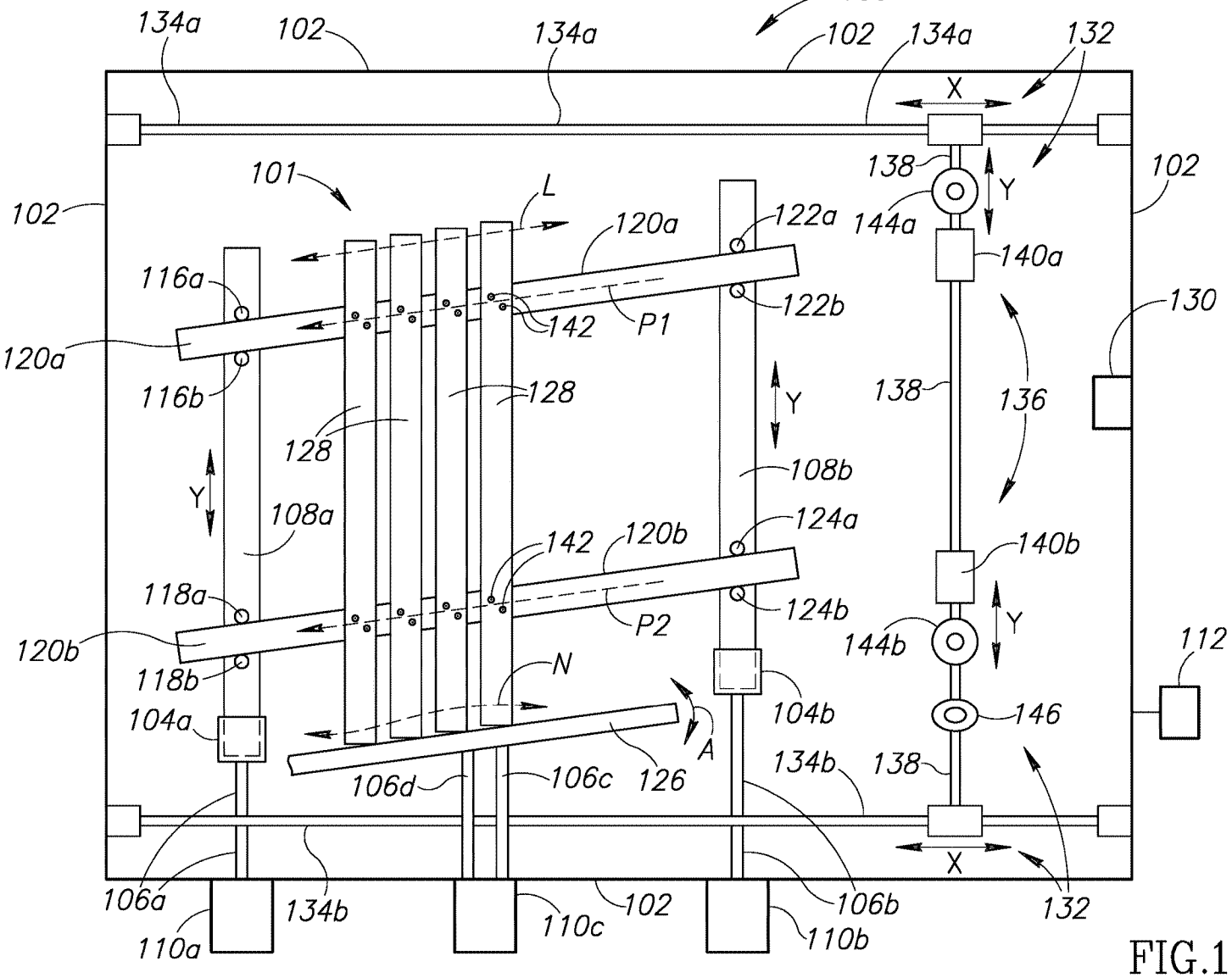
FIG. 1 is a plan view of a fence panel construction device according to an embodiment of the present disclosure.

FIG. 1 shows a fence panel construction device 100 according to an embodiment of the present disclosure. The construction device 100 is operable to create a fence panel 101 to be installed on a property based upon fence line measurements taken on the property. For purposes of illustration, the fence panel 101 is shown partially completed. As discussed above, once the position of each post sleeve or post is known, the fence panel construction device 100 is used to complete an individual fence panel to be secured to a certain pair of fence posts on a property, including fence posts that may be supported in post sleeves on the property.

In some embodiments, the construction device 100 includes a frame 102 supporting a variety of components. The frame 102 is shown as a simple box for purposes of illustration. It will be appreciated that the frame 102 may be comprised of a plurality of structural support members to adequately support the weight of the system, including the forces and moments experienced thereon.

A left post receiver 104*a* is attached to an adjustment member 106*a* and movably coupled to the frame 102. The left post receiver 104*a* is configured to receive and support a left post member 108*a* in a substantially vertically position. An actuator device 110*a* is coupled to the adjustment member 106*a* and is operable to collectively move the left post receiver 104*a* and the left post member 108*a* in a vertical direction relative to the frame 102, as depicted by Arrow Y, to move the left post member 108*a* corresponding to a position of a certain fence post on a property or to a position that otherwise reflects or simulates an environment associated with the fence post. Similarly, a right post receiver 104*b* is attached to an adjustment member 106*b* and movably coupled to the frame 102. The right post receiver 104*b* is configured to receive and support a right post member 108*b* in a substantially vertical position. In some aspects where post sleeves are installed on a property, one or both of the post members 108*a*, 108*b* may be the fence posts themselves and the fence panel 101 may be fastened to one or both of the fence post(s) for installation to the post sleeves. In other instances, the post members 108*a*, 108*b* do not form part of the finished fence and instead are stringer support members that are provided to replicate or simulate the environment between two fence posts or fence post sleeves for the construction of a complete fence panel that fits between said fence posts or post sleeves fitted with posts. In such embodiments, post receivers may not be provided and the stringer support members may be directly repositioned by the adjustment members 106*a*, 106*b*.

In some instances, the frame 102 may support or otherwise operate in the vicinity of a supply of posts that may be cut to length and associated with one or more construction fence panels for subsequent installation. For example, a magazine of posts may be provided to selectively discharge posts in stock form to be cut to a finished height. For this purpose, a pocket saw, a saw movably coupled to the frame 102, or other saw or cutting device may be provided to cut the posts to the finished height. In addition, a printing device or other marking device may be provided to print or otherwise apply or attach a unique identifier to the cut-to-length posts. The unique identifier may have information that associates each post with one or more particular fence panels. The information on the unique identifier(s) may be stored in a database for purposes of construction of a fence on a property and/or for purposes of replacing damaged fence posts previously installed on a property.

The adjustment member 106*b* may be attached to the frame 102. An actuator device 110*b* is attached to the adjustment member 106*b* and is operable to collectively move the right post receiver 104*b* and the right post member 108*b* in a vertical direction, as depicted by Arrow Y, to move the right post member 108*b* to a position corresponding to a position of a certain fence post on a property or to a position that otherwise reflects or simulates an environment associated with the fence post. The adjustment members 106*a*, 106*b* may be worm screw drives for precise control over the position of the respective post members 108*a*, 108*b*, or they may be any other devices to actuate the post members 108*a*, 108*b* to respective desired positions. The actuator devices 110*a*, 110*b* may be motors configured to vertically move respective post receivers 104*a*, 104*b* and post members 108*a*, 108*b*. In some aspects, the actuator devices 110*a*, 110*b* are configured to rotate the post receivers 104*a*, 104*b* about the z axis to adjust for the particular positions of a certain pair of fence posts on a property.

In some aspects, a computer system 112 is coupled to the construction device 100 to control the actuator devices 110*a*, 110*b* for automatic height positioning of the respective post receivers 104*a*, 104*b* and post members 108*a*, 108*b*. Alternatively, the actuator devices 110*a*, 110*b* are hand crank devices coupled to respective adjustment members 106*a*, 106*b* for manual operation to set the post members 108*a*, 108*b* at a desired height relative to the frame 102 and to positions corresponding to or otherwise indicative of positions of certain fence posts on a property, or in positions that replicate or approximate the environment to which the stringers will be ultimately installed. A system of adjustable laser devices could be used in conjunction with the hand cranks to set the post members 108*a*, 108*b* at a desired height by projecting an image or images to represent the desired locations of the post members 108*a*, 108*b* and/or components of the fence panel to be constructed. Alternatively, simple measurement lines or devices could be installed or otherwise used for such purpose.

The left post member 108*a* includes an upper pair of jigs 116*a*, 116*b* and a lower pair of jigs 118*a*, 118*b*. The upper pair of jigs 116*a*, 116*b* are spaced apart vertically a predetermined distance to receive a left end of an upper stringer 120*a*. Likewise, the lower pair of jigs 118*a*, 118*b* are spaced apart vertically a predetermined distance to receive a left end of a lower stringer 120*b*. The right post member 108*b* includes an upper pair of jigs 122*a*, 122*b* and a lower pair of jigs 124*a*, 124*b*. The upper pair of jigs 122*a*, 122*b* are spaced apart vertically a predetermined distance to receive a right end of the upper stringer 120*a*. Likewise, the lower pair of jigs 124*a*, 124*b* are spaced apart vertically a predetermined distance to receive a right end of the lower stringer 120*b*. The predetermined distances between respective pairs of jigs may correspond to the width of typical stringers, such as 2*x*4 or 2*x*6 wood stringers.

The pairs of jigs on both post members 108*a*, 108*b* position the stringers 120*a*, 120*b* at respective desired positions relative to the fence posts to which the stringers 120*a*, 120*b* will be attached at a property. Thus, by individually adjusting the height of the post receivers 104*a*, 104*b* relative to the frame 102 and corresponding to the positions of a certain pair of fence posts on a property, the stringers 120*a*, 120*b* are positioned as they will be installed on the property once the fence panel 101 is complete.

The pairs of jigs on both post members 108*a*, 108*b* may removably attach the stringers 120*a*, 120*b* to respective post members 108*a*, 108*b* by any number of devices or means. For example, the upper jig of each pair of jigs may have a clamping or biasing device to securely hold in place the stringers 120*a*, 120*b*.

In some aspects, once the stringers 120*a*, 120*b* are properly positioned, a topography member 126 is moved to a desired position corresponding to the positions of fence boards 128 to be installed on the stringers. The topography member 126 is attached to a pair of adjustment members 106*c*, 106*d* which are attached to an actuator device 110*c*. The actuator device 110*c* may be coupled to the frame 102 and may operate similarly to the actuator devices 110*a*, 110*b*. The actuator device 110*c* may be operable to independently operate a pair of adjustment members 106*c*, 106*d* in order to move the topography member 126 about the z axis, as depicted by Arrow A, to a desired position. As such, the topography member 126 is positionable to duplicate the topography of the ground of the property so that the fence boards 128 follow the topography of said ground. In some aspects, a plurality of topography members are positioned at corresponding locations to each fence board 128 and are operable to position each fence board 128 at a desired position. Although the topography member 126 is shown as a linear guide, it is appreciated that in other embodiments the topography member may be curvilinear or have a stepped profile.

Once the stringers 120*a*, 120*b* and the topography member 128 are at respective desired positions, the fence boards 128 are positioned substantially vertically and overlying the stringers 120*a*, 120*b*. Accordingly, the lower ends of the fence boards 128 are supported by the topography member 126 until the fence boards 128 are fastened to the stringers 120*a*, 120*b*. Spacers may be positioned between fence boards 128 to properly space the fence boards from each other.

For purposes of illustration, only four fence boards 128 are shown. It will be appreciated that many fence boards 128 would be positioned along the lengths of the stringers 120*a*, 120*b* to complete an entire fence panel 101. Again, fence boards may be positioned on opposing sides of the stringers and in many different configurations.

In some aspects, an automated machine delivers each fence board to the construction device 100 and positions each fence board 128 over the stringers 120*a*, 120*b* accordingly. In other aspects, the fence boards 128 are positioned manually.

A cutting device 130, such as a pocket saw, may be included with the fence panel construction device 100 to rip a final fence board 128 to a precise width according to the total width of the fence panel, which is typically required when constructing fence panels on-site that fit between posts.

Once all the fence boards 128 are at respective positions, the fence boards 128 are fastened to the stringers 120*a*, 120*b*. A finishing assembly 132 is attached to the frame 102 to achieve such fastening operations. The finishing assembly 132 includes a pair of guide members 134*a*, 134*b* positioned substantially horizontal and parallel to each other at respective upper and lower areas of the construction device 100. The finishing assembly 132 includes a fastener array 136 that includes a support member 138 attached to the pair of guide members 134*a*, 134*b*. The support member 138 is positioned substantially vertically and perpendicular relative to the pair of guide members 134*a*, 134*b*. The fastener array 136 may be slideably coupled to the pair of guide members 134*a*, 134*b* and may be movable in horizontal directions along the pair of guide members 134*a*, 134*b*, as depicted by Arrows X. The fastener array 136 may include a motor or manual device operable to move the fastener array 136 in horizontal directions.

The fastener array 136 includes a pair of fastening devices 140*a*, 140*b* attached to the support member 138. The fastening devices 140*a*, 140*b* are either jointly or independently movable along the support member 138 in a vertical direction depicted by Arrow Y. While the fastener array 136 is moved in a horizontal direction, the fastening devices 140*a*, 140*b* are movable in the vertical direction and are operable to fasten the fence boards 128 to respective stringers 120*a*, 120*b*, as depicted by path P1 and path P2 along a central axis of the stringers. Thus, the fastening device 140*a* drives fasteners 142 through upper portions of each fence board 128 and into stringer 120*a*. Concurrently, the fastening device 140*b* drives fasteners 142 through lower portions of each fence board 128 and into stringer 120*b*. The fastening devices 140*a*, 140*b* may be a nail gun, drill gun, staple gun, or the like. Advantageously, in one pass in a horizontal direction from right to left, and in intermittent vertical adjustments between each fence board 128, the fastener array 136 fastens a plurality of fence boards 128 to a pair of stringers 120*a*, 120*b* to create a fence panel 101.

The fastener array 136 may further include a pair of trimming devices 144*a*, 144*b* attached to the support member 138. The pair of trimming devices 144*a*, 144*b* are either jointly or independently movable along the support member 138 in a vertical direction depicted by Arrow Y. As the fastener array 136 is moved in the horizontal direction, the trimming devices 144*a*, 144*b* are movable in the vertical direction and are operable to trim the fence boards 128 to a desired length and shape. Accordingly, the trimming device 144*a* is operable to cut upper ends of each fence board 128, as depicted by linear line L. Simultaneously, the trimming device 144*b* is operable to trim lower ends of each fence board 128 to a desired shape to conform to the topography of the ground over which the fence panel 101 will be installed, as depicted by nonlinear line N, for example. The trimming devices 144*a*, 144*b* may be coupled to computer system operable to control the position and movement of the trimming devices 144*a*, 144*b* based upon information gathered from a property pertaining to the topography of the ground between a certain pair of fence posts. Such information may be obtained from the devices disclosed with reference to U.S. Pat. No. 7,861,434. Alternatively or additionally, the computer system may be operable to control the position and movement of the trimming devices 144*a*, 144*b* based upon a set of instructions corresponding to the pitch between the post members 108*a*, 108*b*, for example.

Thus, the fastening devices 140*a*, 140*b* and the trimming devices 144*a*, 144*b* are movable in any direction in the x-y plane within the frame 102. Thus, in one pass in a horizontal direction, the fastener array 136 fastens and trims a plurality of fence boards to a pair of stringers to create a fence panel 101 ready to be installed to a pair of adjacent posts on a property. The trimming devices 144*a*, 144*b* may be routers, circular or skill saws, or the like. The fastening devices 140*a*, 140*b* and the trimming devices 144*a*, 144*b* may also be moveable in the z direction to accommodate varying positions of the guide posts 108*a*, 108*b*.

In some embodiments, the fastening devices 140*a*, 140*b* are positioned off-set from the trimming devices 144*a*, 144*b*, such as in a forward positioned toward the fence panel 101. Thus, the fastening devices 140*a*, 140*b* first fasten a respective fence board 128 and then the trimming devices 144*a*, 144*b* will follow thereafter to trim the respective fence board 128, so that the respective fence board 128 that was just fastened does not move during the trimming process.

The fastener array 136 may include a pair of support members positioned proximate and parallel to each other (instead of a single support member, as shown on FIG. 1). The fastening devices may be positioned on a left support member and the trimming devices may be positioned on a right support member. The second support member may be operable to move with and follow the second support member so that the fastening devices fasten the fence board and then the trimming devices trim the fence boards thereafter.

In some aspects, the fastener array 136 includes only one fastening device and only one trimming device to fasten and trim all the fence boards. The fastener device and trimming device may be attached as one unit or housing attached to the support member. In other aspects, a fastening device is coupled to the frame and operable independently of a trimming device. As such, said trimming device may be coupled to a different portion of the frame and is operable independently of said fastening device. In other aspects, a user can operate a hand-held fastening device and a hand-held trimming device after the left and right post members are positioned at desired positions.

The trimming devices 144*a*, 144*b* may be operable to trim the ends of the stringers 120*a*, 120*b*. The fastener array 136 may be operable to fasten stringer hardware to the stringers 120*a*, 120*b*.

The fastener array 136 may include a printing device 146 to print or otherwise apply or attach a unique identifier to a constructed fence panel, such as, for example, by applying or attaching the identifier to at least one of the stringers or fence boards. Preferably, the identifier is attached or applied to an end of the stringer so as to not be visible when the fence panel is installed to form a finished fence. The unique identifier may have information that corresponds to the completed fence panel and/or components thereof. The information on the unique identifier(s) may be stored in a database for purposes of construction of a fence on a property and/or for purposes of replacing damaged fence panels previously installed on a property.

In some aspects, either before or after making a fence panel 101, the post members 108*a*, 108*b* (or other support members) may be removed from the post receivers 104*a*, 104*b* and replaced with standard posts to be installed on a property. Because the height of each standard post is known, the construction device 100 may be operable to cut the standard posts at upper ends of the posts to the predetermined lengths. The trimming device 144*a* or other cutting device mounted (or not mounted) to the system may be used to cut the upper ends of the posts, or an additional cutting device may be coupled to the frame and used for such purpose. In other instances, the frame 102 may support or otherwise operate in the vicinity of a supply of posts that may be cut to length and associated with one or more construction fence panels for subsequent installation. For example, as described earlier, a magazine of posts may be provided to selectively discharge posts in stock form to be cut to a finished height. For this purpose, a pocket saw, a saw movably coupled to the frame 102, or other saw or cutting device may be provided to cut the posts to the finished height.

In some aspects, a different set of post members may be attached to the post receivers 104*a*, 104*b* to accommodate for fence panels having at least three stringers. Accordingly, each post member may have three pairs of jigs to attach the three stringers.

In some aspects, a computer system 112 is coupled to the construction device 100 and includes a controller configured to cause all or some of the operations discussed in the present disclosure to create a fence panel 101. For example, an operator can input or upload fence design instructions into the computer system and press "start." The computer system may cause the post members to be positioned at desired heights and the stringers to be positioned on the post members at desired positions. The computer system may cause the fastener array to move along the fence panel to fasten and trim the fence boards, for example. Once the fence panel is complete, the computer system may cause removal of the completed fence panel and may prepare the construction device 100 for construction of another custom fence panel. The process may continue until an entire custom fence panel system is complete and ready for installation on a property.

It will be appreciated that the construction device 100 may include additional features and additional functionality to create any particular fence panel. For example, a top fascia member may be fastened to an upper area of a fence panel. Lattice may be fastened to the fence panel using the components of the construction device 100. The construction device 100 may be operable to create a fence panel having a single stringer. Alternatively, a fence panel may be created without a stringer, such as by fastening the fence boards to each other or with individual attachment devices between the fence boards. Furthermore, the construction device 100 could be used to make other fence panels comprised of iron, vinyl, composites, and the like, or any combination thereof.

Figure 2:
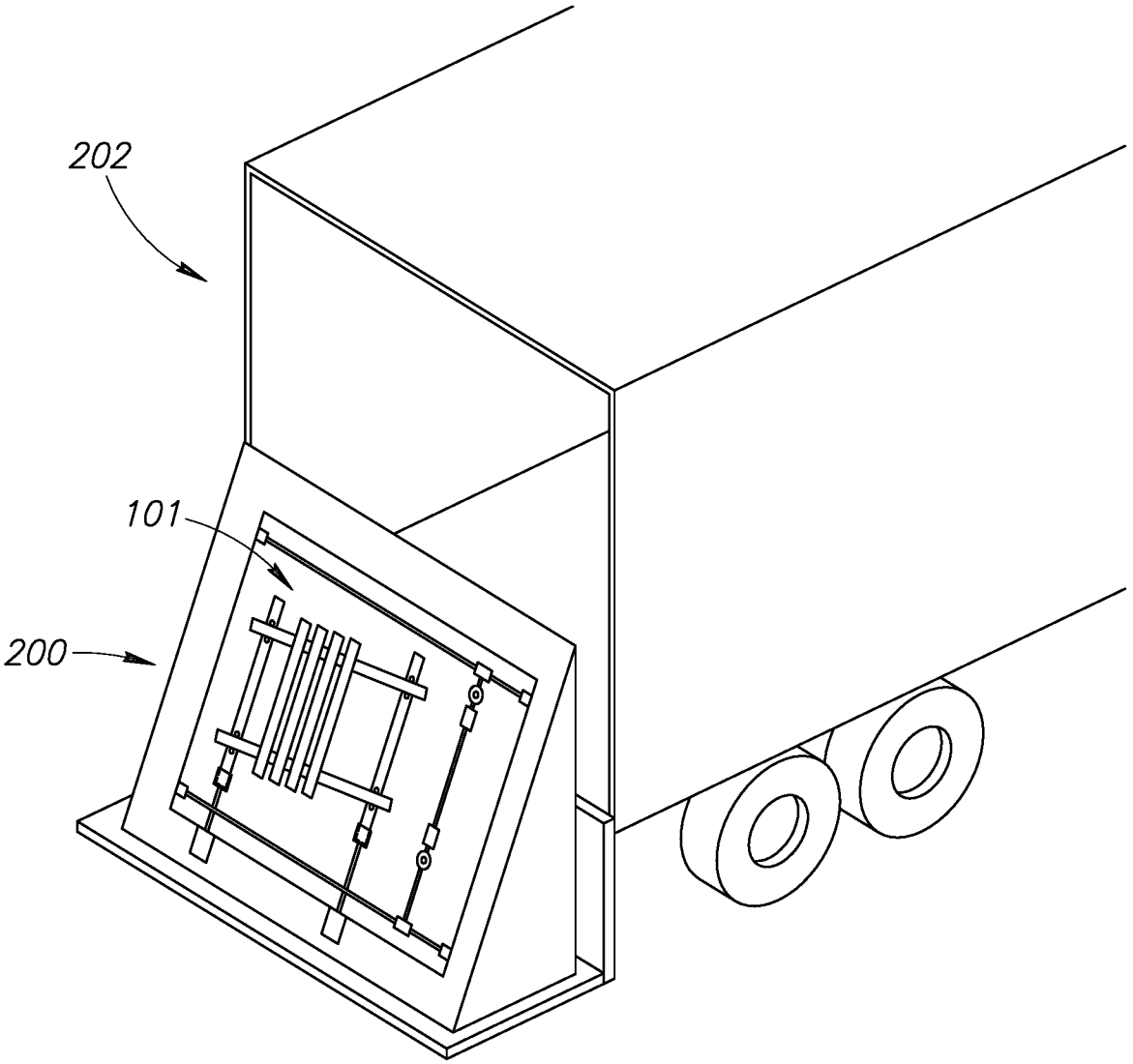
FIG. 2 is a fence panel construction device mounted to a vehicle according to an embodiment of the present disclosure.

FIG. 2 shows a fence panel construction device 200 according to an embodiment of the present disclosure. The construction device 200 is mounted to a truck 202 so that fence panels 101 could be created at a single location proximate a property on which the fence panels are to be installed. Thus, the construction device 200 can be a mobile unit. The construction device 200 may also be secured to a structure for users to create fence panels off-site, such as at a building material store or a manufacturing warehouse.

The construction device 200 shown in FIG. 2 may have some or all of the features discussed with reference to FIG. 1. The construction device 200 is shown mounted at a slight backward angle relative to vertical. As such, the fence boards may lay against the stringers without falling forward before being fastened to the stringers.

The mobility of the construction device 200 provides the advantage of locating the tools for constructing a fence panel at a single location on a construction site (as opposed to carrying tools, electrical cables, air lines, air compressors, and the like to each fence panel location on a property for construction of the fence panel). Moreover, the construction device 200 may be portable such that it can be transported to a job site or other location, such as, for example, a home improvement store, and left on site for subsequent use.

Constructing the fence panels at a single location is particularly advantageous on large construction sites or properties that may require thousands of feet of fencing. Moreover, constructing the fence panels at a single location and, in some embodiments with a machine, can dramatically increase quality and consistency while also reducing labor costs. Constructing the fence panels at a single location improves safety because most or all of the steps to create a fence panel are semi-automated or fully automated, thereby reducing the risk of injury to a worker that would otherwise use hand tools on-site, which is often a property of uneven ground. Safety is further improved because electrical lines are no longer lying throughout a construction site around a fence line, which is of particular concern when standing water is present.

Aspects of the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including U.S. Provisional Application Ser. No. 61/779,577 and U.S. patent application Ser. No. 14/210,031, filed Mar. 13, 2014, are hereby incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system to fabricate a fence panel, the system comprising:

a first stringer attachment device configured to receive and support a first end of a fence stringer;

a second stringer attachment device configured to receive and support a second end of the fence stringer opposite the first end;

a first actuator mechanism operatively connected to the first stringer attachment device to move the first stringer attachment device, independent of the second stringer attachment device, to position the first stringer attachment device in a first position;

a second actuator mechanism operatively connected to the second stringer attachment device to move the second stringer attachment device, independent of the first stringer attachment device, to position the second stringer attachment device in a second position; and a computer system configured to control operation of the first actuator mechanism and the second actuator mechanism, to control movement of the first stringer attachment device and the second stringer attachment device, and to control movement of the first and second ends of the fence stringer.

2. The system of claim 1, further comprising at least one fastening device operable to fasten at least one fence board to the fence stringer.

3. The system of claim 2 wherein the computer system is configured to control movement of the at least one fence board.

4. The system of claim 2 wherein the computer system is configured to control operation of the fastening device.

5. The system of claim 2 wherein the computer system is configured to control movement of the fastening device.

6. The system of claim 1, further comprising at least one trimming device operable to trim portions of the fence panel.

7. The system of claim 6 wherein the computer system is configured to control operation of the trimming device.

8. The system of claim 6 wherein the computer system is configured to control movement of the trimming device.

9. The system of claim 1 wherein the computer system is configured to control operation of the first actuator mechanism and the second actuator mechanism based on stored information regarding topography of a piece of property at which the fence panel is to be installed.

10. The system of claim 1 wherein the computer system is configured to control operation of the first actuator mechanism and the second actuator mechanism based on fence design information provided by a user.

11. The system of claim 1 wherein the computer system is configured to initiate removal of the fence panel from the system.

12. The system of claim 1 wherein the system is located at a building material store.

13. The system of claim 1 wherein the system is located at a manufacturing warehouse.

14. The system of claim 1 wherein the system is located at a home improvement store.

* * * * *